US005231776A

United States Patent [19]

Wagner

[11] Patent Number: 5,231,776

[45] Date of Patent: Aug. 3, 1993

[54] INTEGRALLY WEIGHTED ATHLETIC SHOE

[75] Inventor: Rodger D. Wagner, Inglewood, Calif.

[73] Assignee: Paul S. Orloff, Beverly Hills, Calif.

[21] Appl. No.: 917,419

[22] Filed: Jul. 23, 1992

[51] Int. Cl.[5] ..... A43B 5/00

[52] U.S. Cl. ..... 36/114; 36/132; 36/1; 482/79; 482/105

[58] Field of Search ..... 36/114, 132, 136, 1, 36/28, 29; 482/79, 105

[56] References Cited

U.S. PATENT DOCUMENTS

| | | | |
|---|---|---|---|
| 1,990,970 | 2/1935 | Wood | 36/132 |
| 3,109,245 | 11/1963 | Glynn | 36/114 |
| 4,133,118 | 1/1979 | Khalsa et al. | 36/29 |
| 4,170,078 | 10/1979 | Moss | 36/28 |
| 4,229,889 | 10/1980 | Petrosky | 36/29 |
| 4,451,994 | 6/1984 | Fowler | 36/29 |
| 4,686,781 | 8/1987 | Bury | 36/132 |
| 4,709,921 | 12/1987 | Valuikas et al. | 36/132 |
| 4,779,359 | 10/1988 | Famolare, Jr. | 36/28 |

*Primary Examiner*—Steven N. Meyers
*Assistant Examiner*—M. D. Patterson
*Attorney, Agent, or Firm*—Monty, Koslover Assoc.

[57] ABSTRACT

A weighted athletic, training or sport shoe is disclosed. In the present invention, a weight is distributed over the entire bottom of the athletic shoe, but inside the shoe. The weight comprises a large number of small metal spheres of less than 1 mm diameter, arranged in a lattice grid matrix which is molded to the sole and sandwiched between the inner and outer sole of the shoe. From the outside, the shoe appears to be a stylish athletic shoe. The bottom of the shoe is flexible and comfortable because of the method of integrating the weight.

1 Claim, 1 Drawing Sheet

INTEGRALLY WEIGHTED ATHLETIC SHOE

BACKGROUND AND SUMMARY OF THE INVENTION

This invention relates to an athletic shoe suitable for exercising or practicing for sporting events. More particularly, the invention relates to shoes that are weighted for exercising and training purposes.

Weighted athletic shoes have been available for more than 30 years. In general, they have been used by persons who practice for participation in sporting events such as marathon running or other events requiring prolonged stamina and endurance qualities. The weighted shoes are thought to increase leg strength as well enhancing a cardiovascular workout during a running session.

The types of weight athletic shoes available have all used weights, either attached strapped to the ankles around the shoe or otherwise attached or sewn on the external surface of the shoe. Examples of this approach to weighted athletic shoes are to be found in U.S. Pat. Nos. 4,458,432 to Frank Stempski, 4,777,743 to August E. Roehrig, 3,114,982 to Maurice R. McGowan, and 3,406,968 to G. Mason.

The above are merely a few of the any variations found in a search of the literature and in a review of sporting equipment stores. An important aspect lacking in all the found shoe variation is that of style. All the shoes look weighted of 'strange' looking, and to many this is a deterrent to their use. Furthermore, according to athletes of the inventor's acquaintance, the most desirable place for a shoe weight is at the bottom of the shoe. This is most difficult to achieve with the various available add-on external weights, while still preserving flexibility of the shoe sole.

In the present invention, a weight is distributed over the entire bottom of the athletic shoe, but inside the shoe. The weight comprises a large number of small metal spheres of less than 1 mm diameter, arranged in a matrix which is sandwiched between the inner and outer sole of the shoe. From the outside, the shoe appears to be a stylish athletic shoe. The bottom of the shoe is flexible and comfortable because of the method of integrating the weight.

It is therefore an object of the present invention to provide an integrally weight athletic shoe which has a weight distributed over the entire bottom of the shoe, while preserving flexibility of the shoe sole.

Another object of the present invention is to provide a weighted athletic shoe that can look stylish as desired by the wearer, and not appear to be weighted.

An advantage is that there is no danger of a weight accidentally falling off or shifting on the shoe during exercise, as may occur with conventional externally weighted shoes.

Further objects and advantages of the present invention will become apparent rom a study of the following portion of the specification, the claims and the attache drawings.

DESCRIPTION OF THE PREFERRED EMBODIMENT

Figure 1:
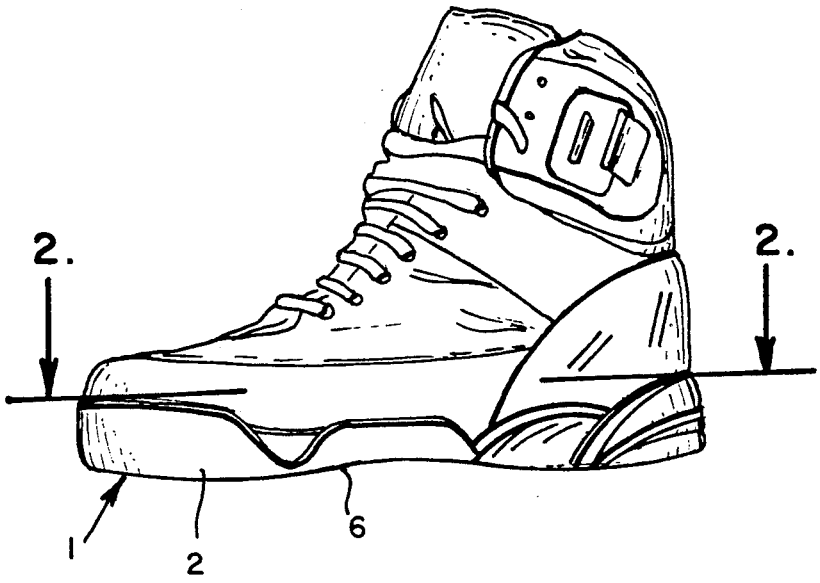
FIG. 1 is a side elevation view of a typical athletic shoe which has a weighted sole integrated in it according to the present invention.

Referring particularly to the drawings, there is shown in FIG. 1 a view of an integrally weighted athletic shoe 1 incorporating the preferred embodiment. As can be seen, the appearance is that of a stylish athletic shoe, with no hint of it being a training or weighted shoe.

Figure 2:
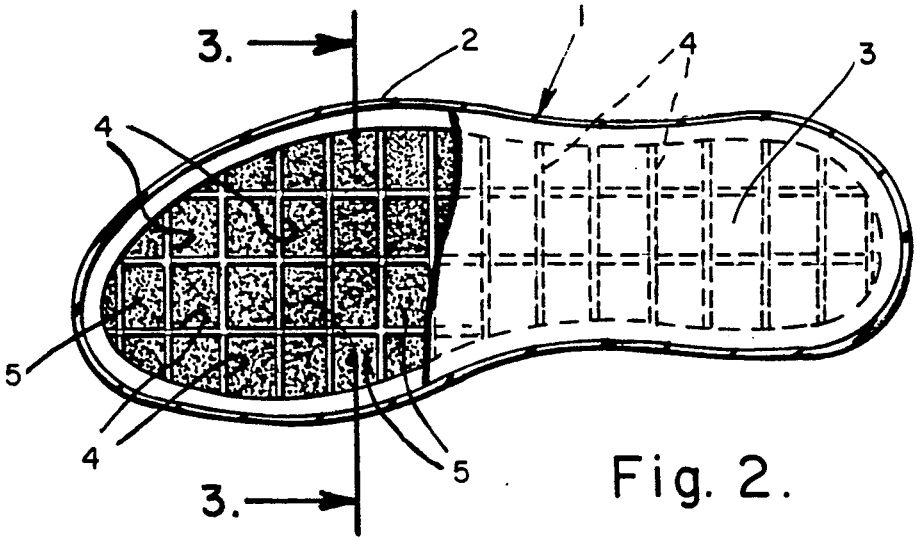
FIG. 2 is a cutaway plan view of the invention taken rom the pane indicated by line 2—2 of FIG. 1, particularly showing part of a lattice grid weight matrix embedded in the sole and heel of the shoe across the entire bottom.
Figure 3:
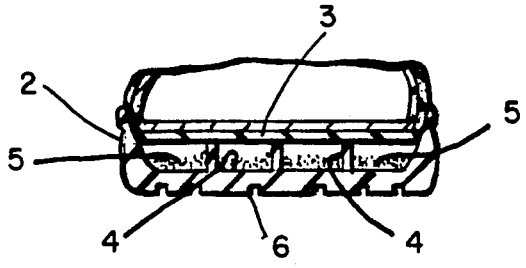
FIG. 3 is a cross-section view of the bottom of the shoe taken across line 3—3 of FIG. 2, particularly showing the molded nature of the construction and weight spheres in the enclosures formed by the matrix and the sole.

The shoe comprises a sole-heel portion 6, an upper portion, a lace or tie closure and a top or collar portion which fastens around the ankle. The term 'sole-heel portion' includes the heel in this usage, meaning that which comprises the entire bottom portion of the shoe. In this invention, an added weight is distributed over the bottom of the shoe, but inside the sole-heel portion 6. FIGS. 2 and 3 illustrate how this is achieved.

Referring now to FIGS. 2 and 3, there is shown a partially cutaway plan view of the sole-heel portion 6 as seen after shearing off (for illustration only) the upper along line 2—2 of FIG 1, and a cross-section of the sole-heel portion 6 in FIG. 3. The innersole 3 is depicted peeled back to show a matrix 4 which i molded to the sole-heel 6, forming a flexible lattice grid structure, having a multiple number of enclosures covering the entire area of the sole and heel. This matrix 4 is the means selected for retaining weights inside the shoe.

As shown in the cross-section view of FIG. 3, the matrix 4 enclosures are partly filled with metal spheres 5 having a diameter of less than 1 mm, leaving a space between the metal spheres 5 and the innersole 3 which lies on top of the matrix. The metal spheres 5 provide the weight which is distributed evenly over the bottom of the shoe. The matrix 4 lattice grid walls prevent the spheres 5 from changing position and bunching up, while the vertical space left between the spheres 5 and the innersole 3 permits a comfortable tread and running flexibility as the weight of the foot is brought to bear on the sole-heel portion.

In manufacturing, the under surface of the innersole 3 is adhered to the top of the matrix 4 lattice grid, and the innersole 3 edges joined to the upper wall 2 of the sole-heel portion, thus sandwiching the matrix 4 containing the sphere weights 5 securely in place so that the weight distribution can not shift.

It should be noted that the amount of weight added integrally in the sole-heel portion of the shoe may be deliberately varied in manufacture, and result in sets of shoes carrying different weights. This allows for variation in users training regimes and desires which may call for a heavy weighted shoe at one time and a lighter weight at another.

Furthermore, because the external surface of the integrally weighted athletic shoe is clear of weight encumbrances, it can be made as stylish as wished. The addition f strap-on weights to the upper surfaces, if so desired, is not precluded.

From the above description it is apparent that the preferred embodiment achieves the objects of the present invention. It will be understood by those skilled in the art that various changes may be made and substituted for elements of the preferred embodiment. These alternatives are considered to be within the spirit and scope of the present invention.

Having described the invention, what is claimed is:

1. An athletic shoe comprising:

a bottom portion;

an upper portion secured to said bottom portion;

a lace closure which is attached to said upper portion at the front of said shoe; and a top collar shaped portion which is attached to said upper portion and which is used to fasten around the ankle;

said bottom portion comprising: an outer sole extending the length of the shoe, including the heel; a weight-retaining matrix means molded to the inside surface of said outer sole, said matrix means including a flexible grid structure forming a multiple number of approximately equal area enclosures covering the entire area of the sole and heel; an inner sole fastened to the top of said flexible grid structure; and a multiplicity of small metal spheres of less than 1 mm diameter acting as flexible integral weights, said metal spheres being placed inside the boxes formed by said flexible grid structure prior to fastening said inner sole in place, and leaving a substantial space between said metal spheres and the top of said grid structure;

said grid structure being for the purpose of retaining said metal spheres distributed uniformly in place, preventing them from shifting over the sole area and bunching;

said small metal spheres and said space between them and said inner sole being for the purpose of enhancing shoe comfort to the wearer and providing running flexibility;

said weight-retaining matrix means being formed integrally inside said bottom portion, and said small metal spheres weight material being contained inside said matrix means, uniformly distributed over the entire area of the sole and heel of said shoe; said weight-retaining matrix and said small metal spheres providing a hidden, flexible increased weight for the shoe wearer to use when exercising.

* * * * *